US009521482B2

(12) United States Patent
Hu et al.

(10) Patent No.: US 9,521,482 B2
(45) Date of Patent: Dec. 13, 2016

(54) SOUND RECEIVING DEVICE

(71) Applicant: GUANGZHOU RUIFENG AUDIO TECHNOLOGY CORPORATION LTD., Guangzhou, Guangdong (CN)

(72) Inventors: Bingqi Hu, Guangdong (KR); Yizhen Wang, Guangdong (CN)

(73) Assignee: GUANGZHOU RUIFENG AUDIO TECHNOLOGY CORPORATION LTD., Guangzhou (CN)

( * ) Notice: Subject to any disclaimer, the term of this patent is extended or adjusted under 35 U.S.C. 154(b) by 4 days.

(21) Appl. No.: 14/395,254

(22) PCT Filed: Sep. 30, 2013

(86) PCT No.: PCT/CN2013/084791
§ 371 (c)(1),
(2) Date: Oct. 17, 2014

(87) PCT Pub. No.: WO2014/071789
PCT Pub. Date: May 15, 2014

(65) Prior Publication Data

US 2015/0086037 A1 Mar. 26, 2015

(30) Foreign Application Priority Data

Nov. 8, 2012 (CN) ..... 2012 1 0445453

(51) Int. Cl.
*H04R 3/00* (2006.01)
*H04R 1/02* (2006.01)
*H04R 1/40* (2006.01)

(52) U.S. Cl.
CPC ..... *H04R 1/406* (2013.01); *H04R 3/005* (2013.01); *H04R 2201/403* (2013.01)

(58) Field of Classification Search
CPC .... H04R 1/406; H04R 3/005; H04R 2201/403

(58) Field of Classification Search
USPC ..... 381/92, 122, 91
See application file for complete search history.

(56) References Cited

U.S. PATENT DOCUMENTS 5,715,319 A 2/1998 Chu
6,317,501 B1 11/2001 Matsuo
(Continued)

FOREIGN PATENT DOCUMENTS

CN 1645971 A 7/2005
CN 1711799 A 12/2005
(Continued)

OTHER PUBLICATIONS

International Search Report mailed Jan. 2, 2014 in International Application No. PCT/CN2013/084791.
(Continued)

*Primary Examiner* — Vivian Chin
*Assistant Examiner* — Douglas Suthers
(74) *Attorney, Agent, or Firm* — Polsinelli PC

(57) ABSTRACT

A sound receiving device includes a microphone array, a plurality of time delay circuits and a sound-mixing output device. The microphone array includes a plurality of microphones longitudinally arranged along a straight line in order, an output terminal of each microphone is connected with a time delay circuit, and an output terminal of the time delay circuit is connected to an input terminal of the sound-mixing output device; and an i-th time delay circuit has a delay time Ti defined by adding a (n−i) times of unit time to a delay time of a last time delay circuit. The device can increase the output of the forward acoustic wave actuation, decrease the output of the oblique acoustic wave within a certain frequency bandwidth, and obtain nearly the same directional characteristic at the central frequency and adjacent frequencies.

2 Claims, 2 Drawing Sheets

(56) References Cited

U.S. PATENT DOCUMENTS

| | | | | |
|---|---|---|---|---|
| 6,423,005 | B1 | 7/2002 | Miwa et al. | |
| 2002/0031234 | A1 | 3/2002 | Wenger et al. | |
| 2005/0169487 | A1* | 8/2005 | Soede ..... | H04R 3/005 381/92 |
| 2005/0213432 | A1 | 9/2005 | Hoshuyama | |
| 2006/0133621 | A1 | 6/2006 | Chen et al. | |
| 2006/0133622 | A1 | 6/2006 | Chen | |
| 2006/0135085 | A1 | 6/2006 | Chen | |
| 2006/0147063 | A1 | 7/2006 | Chen | |
| 2006/0154623 | A1 | 7/2006 | Chen et al. | |
| 2007/0116300 | A1 | 5/2007 | Chen | |
| 2009/0209290 | A1 | 8/2009 | Chen et al. | |
| 2010/0220877 | A1 | 9/2010 | Ishibashi et al. | |

FOREIGN PATENT DOCUMENTS

| | | | |
|---|---|---|---|
| CN | 1874368 | A | 12/2006 |
| CN | 101218847 | A | 7/2008 |
| CN | 101543901 | A | 9/2009 |
| CN | 102761805 | A | 10/2012 |
| CN | 102970639 | A | 3/2013 |
| CN | 103002389 | A | 3/2013 |
| CN | 202940957 | U | 5/2013 |
| CN | 202949553 | U | 5/2013 |
| JP | 2005-260743 | A | 9/2005 |
| JP | 2007006353 | A | 1/2007 |

OTHER PUBLICATIONS

Chinese Office Action issued Aug. 11, 2014 for counterpart Chinese Application No. 201210445453.6.

Chinese Office Action issued Mar. 9, 2015 for counterpart Chinese Application No. 201210445453.6.

Chinese Office Action issued Jul. 13, 2015 for counterpart Chinese Application No. 201210445453.6.

International Search Report and Written Opinion mailed Jan. 2, 2014 for corresponding PCT Application No. PCT/CN2013/084791.

* cited by examiner

SOUND RECEIVING DEVICE

RELATED APPLICATIONS

This application is a United States National Stage Application filed under 35 U.S.C 371 of PCT Patent Application Serial No. PCT/CN2013/084791, filed Sep. 30, 2013, which claims priority to Chinese Patent Application Serial No. CN201210445453.6, filed Nov. 8, 2012, the disclosure of all of which are hereby incorporated by reference in their entirety.

TECHNICAL FIELD

The present invention relates to the field of sound processing technology, and more particularly, to a sound receiving device with a longitudinal linear array including a plurality of microphones.

BACKGROUND

In applications of sound reinforcement equipment, a major problem that affects the gain of a sound reinforcement system is that the direct sound received by a microphone has the same frequency and same phase as the acoustic signals fed back by various reasons. It thus is easy to generate a positive feedback and cause howling in the sound reinforcement system.

The feedback acoustic wave and the acoustic wave ought to be received by the microphone are generally heading in different directions, so the most common approach to solve the above problem is to enhance the directional characteristic of the microphone to reduce the impact of the feedback acoustic wave.

The existing cardioids or super cardioids microphone is generally most sensitive to the acoustic wave input incoming the front, and is not sensitive to the acoustic wave incoming from the back, such that the feedback acoustic wave from the back can be inhibited, but sometimes the feedback acoustic wave incoming from above, below, left or right would also causes interference.

The "8" shaped direction microphone is generally sensitive to the acoustic wave incoming both from the front and back, and is not sensitive to the acoustic wave incoming from above, below, left or right. Thus, the feedback problem of the acoustic wave from back still can't be resolved.

In addition, the existing cardioids, super cardioids and "8" shaped direction microphone have different directional responses for acoustic waves with different frequencies.

There is always a stringent requirement for a single microphone to operate in a sound environment due to limitations of gain characteristic, directional characteristic, frequency response, and so on. It is often difficult to obtain a good result of sound pickup (sound transmitting) when the sound environment is relatively complex. For example, a decrease in output gain, distortion or howling could happen because of the far distance between a target sound source and a sound pickup (sound transmitting) device, a hard angle, a severe background noise or a strong feedback. Especially when the sound reinforcement equipment should be supported by a multitude of sound pickup (sound transmitting) devices, it is rather complex in regulation and adjustment. Thus, it becomes necessary to have a sound pickup (sound transmitting) device, which outputs a higher gain for a forward acoustic wave actuation, plays a greater inhibition role in oblique acoustic waves, and has a stable directivity, to simplify demands of the sound reinforcement equipment on environment, so as to meet the requirements of sound pickup (sound transmitting) in an environment with a stronger acoustic wave feedback and a higher environmental noise, achieve remote sound pickup (sound transmitting), simplify the device regulation and operation, and obtain a good result of sound reinforcement.

SUMMARY

In order to solve the above problems, the object of the present invention is to provide a sound receiving device, which has a simple structure, and has a good directional reception of an acoustic wave for output.

The proposed technical solution of the present invention is to provide a sound receiving device, including a microphone array, a plurality of time delay circuits and a sound-mixing output device, wherein the microphone array includes a plurality of microphones longitudinally arranged along a straight line in order, two adjacent microphones in the microphone array are separated with a distance of $$\frac{1}{n}\lambda_0,$$

where n is the total number of the microphones in the microphone array and $\lambda_0$ is a wavelength derived from a preset center frequency;

in the microphone array, an output terminal of each microphone is connected with a time delay circuit, and an output terminal of the time delay circuit is connected to an input terminal of the sound-mixing output device;

an i-th time delay circuit has a delay time Ti defined by adding a (n−i) times of unit time to a delay time of a last time delay circuit, where said unit time is a time for an acoustic signal with a frequency set at a given center frequency to travel between two adjacent microphones after the acoustic signal axially transmitting into the microphone array, n is the total number of the microphones in the microphone array, and i has a value of 1, 2, 3, . . . , or n; and the total number n of the microphones in the microphone array is an integer greater than or equal to 3.

Preferably, the total number n of the microphones in the microphone array is an even number greater than or equal to 4.

The present invention has the advantages that the sound receiving device of the present invention can increase the output of the forward acoustic wave actuation due to the microphone array composed by discrete, equally spaced and longitudinally aligned microphones based on the preset center frequency in the sound receiving device, and the sound receiving device can decrease the output of the oblique acoustic wave within a certain frequency bandwidth and obtain an approximately identical directional characteristic at the central frequency and adjacent frequencies. In this way, the sound receiving device of the present invention can still obtain a good result of sound pickup (sound transmitting) in an environment with a stronger acoustic wave feedback and a higher environmental noise. In addition, the present invention has simple structure, convenient implementation and low cost.

BRIEF DESCRIPTION OF THE DRAWINGS

The accompanying drawings, which are incorporated into and constitute a part of this specification, illustrate one or more examples of embodiments and, together with the description of example embodiments, serve to explain the principles and implementations of the embodiments.

In the drawings.

DETAILED DESCRIPTION OF THE PREFERRED EMBODIMENTS

Those of ordinary skill in the art will realize that the following description is illustrative only and is not intended to be in any way limiting. Other embodiments will readily suggest themselves to such skilled persons having the benefit of this disclosure. Reference will now be made in detail to implementations of the example embodiments as illustrated in the accompanying drawings. The same reference indicators will be used to the extent possible throughout the drawings and the following description to refer to the same or like items.

Figure 1:
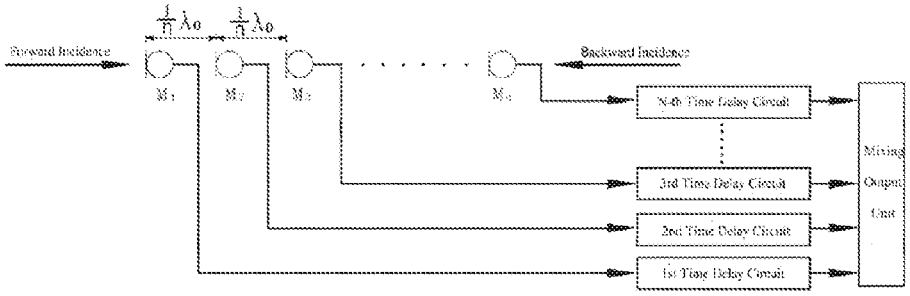
FIG. 1 is a structure diagram illustrating a sound receiving device according to one embodiment of the present invention.

As shown in FIG. 1, a sound receiving device includes a microphone array, a plurality of time delay circuits and a sound-mixing output device, wherein the microphone array includes a plurality of microphones which are M1, M2, M3, . . . , and Mn, and each of the microphones has basically the same frequency response, sensitivity, directional characteristic and other properties.

The plurality of microphones M1, M2, M3, . . . , and Mn are longitudinally arranged along a straight line in order, and two adjacent microphones in the microphone array are separated with a distance of $$\frac{1}{n}\lambda_0,$$

that is the spacing distance between any two adjacent microphones in the microphone array is the same and the spacing distance is $$\frac{1}{n}\lambda_0,$$

where n is the total number of the microphones in the microphone array and $\lambda_0$ is a wavelength derived from a preset center frequency. The $\lambda_0$ is defined by:

$$\lambda_0 = \frac{C_0}{f_0}.$$

In this case, $\lambda_0$ represents the wavelength, $C_0$ represents the speed of the acoustic wave in the air, and $f_0$ represents the center frequency.

In the microphone array, an output terminal of each microphone is connected with a time delay circuit, and an output terminal of the time delay circuit is connected to an input terminal of the sound-mixing output device. As shown in FIG. 1, the microphone array includes n microphones M1, M2, M3, . . . , and Mn, the output terminal of each of the microphones is respectively connected with a time delay circuit, and the output terminal of the time delay circuit is connected to the input terminal of the sound-mixing output device.

An i-th time delay circuit has a delay time Ti defined by adding a (n−i) times of unit time to a delay time of a last time delay circuit, that is the i-th time delay circuit has a delay time Ti defined by adding a (n−i) times of unit time to a delay time of the n-th time delay circuit. The unit time is a time for an acoustic signal with a frequency set at a given center frequency to travel between two adjacent microphones after the acoustic signal axially transmitting into the microphone array. The acoustic signal axially transmitting into the microphone array means that the acoustic signal transmits into the microphone array at an incidence angle of 0° or 180°. In addition, because the acoustic signal transmits into the microphone array axially, it can be known from the above that the distance between the two adjacent microphones that the acoustic signal travels is a straight-line distance between the two adjacent microphones, in this case, $$\frac{1}{n}\lambda_0,$$

thereby the time for the acoustic signal to travel between the two adjacent microphones is defined by:

$$t = \frac{1}{n}\lambda_0/C_0.$$

Ti is defined as the delay time of the i-th time delay circuit, and is such that $$T_i = \frac{(n-i)\cdot\lambda_0}{n\cdot C_0} + A,$$

where n is the total number of the microphones in the microphone array, i has a value of 1, 2, 3, . . . , or n, $C_0$ represents the speed of the acoustic wave in the air, and A represents the delay time of the last time delay circuit, that is A represents the delay time of the n-th time delay circuit and A can be set as any time depend on actual requirements. When i is 1, $T_1$ represents the delay time of the 1st time delay circuit, and the 1st time delay circuit is the time delay circuit connected with the 1st microphone $M_1$. When i is 2, 3, 4, . . . , n, the situation is similar to the above. For the n-th microphone $M_n$, if the delay time of the n-th time delay circuit which is connected to the n-th microphone $M_n$ is 0, the output terminal of the n-th microphone $M_n$ can be not connected with a time delay circuit, and the output terminal can be directly connected with the input terminal of the sound-mixing output device.

The center frequency $f_0$ may be preset, that is the center frequency is set primarily based on users' actual demands in advance. For example, when users need a sound receiving device which can achieve maximum gain output for an acoustic signal of 900 Hz, the center frequency $f_0$ would be set as 900 Hz. In this case, the spacing distance between the two adjacent microphones in the microphone array and the delay time of each of the time delay circuits can be determined during production, after the number of the microphones is determined based on actual requirements. This will result in a sound receiving device which can achieve maximum gain output for a forward acoustic signal of 900 Hz and maximum inhibition for a backward acoustic signal of 900 Hz, with a certain directional characteristic.

The instructions for the process of the present invention are basic and detailed below.

According to general knowledge in the art, an acoustic wave may be expressed as a mathematical expression as follows:

$$P=Pa\cos(\omega t-\phi).$$

When two acoustic waves with the same frequency are superposed together, there is $$Pa2=P1a2+P2a2+2P1aP2a\cos(\phi2-\phi1).$$

Then the superposition of two acoustic waves with the same amplitude is as follows.

When the phase difference between the two acoustic waves is 0°, i.e., when $\phi2-\phi1=0$, the superposition of the two acoustic waves can be expressed as $$Pa2=P1a2+P2a2+2P1aP2a=(P1a+P2a)2=(2P1a)2$$
and $$LPa=101g(Pa/P0)2=101g(2P1a/P0)2=101g(P1a/P0)2+101g4=LP1a+6\text{ dB}.$$

From here we see that when two acoustic waves with the same frequency, phase and amplitude, are superposed together, the amplitude of the superposed acoustic wave is twice as that of each of the acoustic waves to be superposed, increasing about 6 dB.

When the phase difference between the two acoustic waves is 60°, i.e., when $$\varphi2=\varphi1=\frac{1}{3}\pi,$$

the superposition of the two acoustic waves can be expressed as $$Pa2=P1a2+P2a2+2P1aP2a\times½=3P1a2\text{ and}$$

$$LPa=101g(Pa/P0)2=101g(3P1a/P0)2=101g(P1a/P0)2+101g3=LP1a+4.8\text{ dB}.$$

From here we see that when two acoustic waves with the same frequency and amplitude and with a phase difference of $$\frac{1}{3}\pi,$$

are superposed together, the amplitude of the superposed acoustic wave is $\sqrt{3}$ times as that of each of the acoustic waves to be superposed, increasing about 4.8 dB.

When the phase difference between the two acoustic waves is 90°, i.e., when $$\varphi2=\varphi1=\frac{\pi}{2},$$

the superposition of the two acoustic waves can be expressed as $$Pa2=P1a2+P2a2+2P1aP2a\times0=2P1a2\text{ and}$$

$$LPa=101g(Pa/P0)2=101g2P1a2/P02=101g(P1a/P0)2+101g2=LP1a+3\text{ dB}.$$

From here we see that when two acoustic waves with the same frequency and amplitude and with a phase difference of $$\frac{\pi}{2},$$

are superposed together, the amplitude of the superposed acoustic wave is $\sqrt{2}$ times as that of each of the acoustic waves to be superposed, increasing about 3 dB.

When the phase difference between the two acoustic waves is 120°, i.e., when $$\varphi2=\varphi1=\frac{2}{3}\pi,$$

the superposition of the two acoustic waves can be expressed as $$Pa2=P1a2+P2a2+2P1aP2a\times(-1/2)=2P1a2-P1a2=P1a2.$$

From here we see that when two acoustic waves with the same frequency and amplitude and with a phase difference of $$\frac{2}{3}\pi,$$

are superposed together, the amplitude of the superposed acoustic wave is the same as that of the acoustic wave to be superposed, i.e., the superposed acoustic wave has the same acoustic pressure level as the acoustic waves to be superposed.

When the phase difference between the two acoustic waves is 180°, i.e., when $\phi2-\phi1=\pi$, the superposition of the two acoustic waves can be expressed as $$Pa2=P1a2+P2a2+2P1aP2a\times(-1)=(P1a-P2a)2=0.$$

From here we see that when two acoustic waves with the same frequency and amplitude and with a phase difference of $\pi$, are superposed together, the amplitude of the superposed acoustic wave is zero, i.e., the acoustic waves superposed cancel each other.

Based on the above, the result of superposition of two acoustic waves with the same frequency and amplitude mainly depends on the phase difference between the two acoustic waves, and according to different phase differences between the two acoustic waves, the amplitude of the superposed acoustic wave is different, ranged from zero to as twice as the amplitude of each of the acoustic waves to be superposed.

Similarly, the result of superposition of multiple acoustic waves with the same frequency and amplitude also depends on the phase difference between the multiple acoustic waves, and according to different phase differences between the multiple acoustic waves, the amplitude of the superposed acoustic wave is different, ranged from zero to as twice as the amplitude of each of the acoustic waves to be superposed. For example, when six acoustic waves with the same frequency and amplitude are superposed together, the amplitude of the superposed wave is ranged from 0 to 6PA, where PA is the amplitude of one acoustic wave.

Let the angle between the axial direction of the microphone array of the sound receiving device and the incident direction of the acoustic signal be $\phi$, i.e., the acoustic signal is incident on the microphone array at the angle of $\phi$. The acoustic signal may be a plane wave or an approximate plane wave (far field acoustic signal or approximate far field acoustic signal), and the difference in amplitudes of the acoustic signals received by the microphones due to different transmitting distances may be ignored;

the phase angles of the acoustic signals received by the microphones are $\Phi_i'$ respectively;

the times that the microphones actually receive the acoustic signals are $t_i$ respectively;

the phase angles of the acoustic signals respectively corresponding to the delay times of the time delay circuits are $\Phi_i''$;

the center frequency of the microphone array is $f_0$; and the straight-line distance between the 1st microphone and the n-th microphone is $L_{1-n}$.

When an acoustic signal with a phase angle of $\alpha$ and a frequency of the center frequency $f_0$ is incident on the 1st microphone M1 at a angle of $\phi$ at time t1=0, i.e., the 1st microphone M1 receives an acoustic signal with a phase angle of $\alpha$ and a frequency of the center frequency $f_0$ at time t1=0. The acoustic signal will continue to travel to the i-th microphone Mi after it reaches the 1st microphone M1, the distance it travels from the 1st microphone M1 to the i-th microphone Mi is $$\frac{i-1}{n}\lambda_0\cos\varphi,$$

and the distance between the phase angle of the acoustic signal received by the i-th microphone Mi at $t_i$ and the phase angle of the acoustic signal received by the 1st microphone M1 is $$\Phi_i' = \frac{((i-1)/n)\lambda_0\cos\varphi}{C_0/f_0}\times 360^\circ + \alpha,$$

where $\alpha$ can be omitted, because $\alpha$ is a constant in the above expression when the phase angle of the incident acoustic signal is $\alpha$. In addition, i has a value of 1, 2, 3, . . . , or n, and n is the total number of the microphones.

When an acoustic signal with a phase angle of 0° and a frequency of the center frequency $f_0$ is incident on the 1st microphone M1 at a angle of $\phi$ at time t1=0, i.e., the 1st microphone M1 receives an acoustic signal with a phase angle of 0° and a frequency of the center frequency $f_0$ at time t1=0. The acoustic signal will continue to travel to the i-th microphone Mi after it reaches the 1st microphone M1, the distance it travels from the 1st microphone M1 to the i-th microphone Mi is $$\frac{i-1}{n}\lambda_0\cos\varphi,$$

and the distance between the phase angle of the acoustic signal received by the i-th microphone Mi at $t_i$ and the phase angle of the acoustic signal received by the 1st microphone M1 is $$\Phi_i' = \frac{((i-1)/n)\lambda_0\cos\varphi}{C_0/f_0}\times 360^\circ,$$

where i has a value of 1, 2, 3, . . . , or n. Thus the phase angle $\Phi_i'$ of the acoustic signals received by the 2nd microphone, the 3rd microphone, . . . , n-th microphone respectively can be calculated from the above expression.

The phase angles of the acoustic signals respectively corresponding to the delay times of the time delay circuits are $$\Phi_i'' = \frac{T_i}{1/f_0}\times 360^\circ,$$

where i has a value of 1, 2, 3, . . . , or n.

The phase angle $\Phi_i$ of the acoustic signal output by each time delay circuit is $$\Phi_i=\Phi_i'+\Phi_i''.$$

From here we see that the sound receiving device of the present invention is designed with the idea to ensure that the delay time of the i-th delay circuit is consistent with the time an acoustic signal with a frequency of the center frequency $f_0$ travels to the last microphone after the acoustic signal is forward and axially incident on the i-th microphone.

Suppose the number of microphones in the microphone array of the sound receiving device is less than 3. For example, the number of microphones in the microphone array of the sound receiving device is 2.

In this case, an acoustic signal with a frequency of the center frequency $f_0$ and a phase angle of $\alpha$ is forward and axially incident on the microphone array at a angle of $\phi$, where $\phi$=0°. The acoustic signal travels through the 1st microphone and the 1st time delay circuit in sequence, and the output electrical signal has a phase angle of $\alpha$+180°, where the increased angle of 180° is caused by the time delay circuit. The acoustic signal then travels from the 1st microphone to the 2nd microphone and travels through the 2nd time delay circuit, where the delay time of the 2nd time delay circuit is 0 that the output electrical signal still has a phase angle of $\alpha$+180°. It follows that the phase angle of the electrical signal output from the 1st time delay circuit is consistent with that of the electrical signal output from the 2nd time delay circuit, that is the phase difference between the both electrical signals is 0, such that the electrical signal output from the sound receiving device has a maximum gain.

In another case, an acoustic signal with a frequency of the center frequency $f_0$ and a phase angle of $\alpha$ is backward and axially incident on the microphone array at a angle of $\phi$, where $\phi$=180°. The acoustic signal firstly reaches the 2nd microphone, and travels through the 2nd microphone and the 2nd time delay, where the delay time of the 2nd time delay circuit is 0 that the output electrical signal still has a phase angle of $\alpha$. The acoustic signal travels from the 2nd microphone to the 1st microphone and travels through the 1st time delay circuit, and the phase angle of the output electrical signal is a combination of $\alpha$, 180° caused by the delay time of the time delay circuit and 180° caused by the transmission distance, i.e., $\alpha$+360°. It follows that the phase angle of the electrical signal output from the 2nd time delay circuit lags behind that of the electrical signal output from the 1st time delay circuit by 360°, that is the phase difference between the both electrical signals is 0, such that the amplitude of the electrical signal output from the sound receiving device is also doubled.

That is, for a backward incoming acoustic signal with a frequency of the center frequency $f_0$, the sound receiving device also play a role in double in the amplitude of the acoustic signal.

In other words, a sound receiving device including a microphone array only composed of two microphones cannot play an inhibition role in a backward axially incoming acoustic signal.

Suppose the number of microphones in the microphone array of the sound receiving device is 3. When an acoustic signal with a frequency of the center frequency $f_0$ and a phase angle of $\alpha$ is forward and axially incident on the microphone array. The acoustic signal travels through the 1st microphone and the 1st time delay circuit in sequence, and the output electrical signal has a phase angle of $\alpha$+240°, where the increased angle of 180° is caused by the time delay circuit. The acoustic signal travels from the 1st microphone to the 2nd microphone and travels through the 2nd microphone and the 2nd time delay circuit in sequence, and the output electrical signal has a phase angle as a combination of $\alpha$, 120° caused by the delay time of the time delay circuit and 120° caused by the transmission distance, i.e., $\alpha$+240°. The acoustic signal travels from the 2nd microphone to the 3rd microphone and travels through the 3rd microphone and the 3rd time delay circuit in sequence, where the delay time of the 2nd time delay circuit is 0 that the output electrical signal has a phase angle as a combination of $\alpha$, and 240° caused by the transmission distance, i.e., $\alpha$+240°. It follows that the phase angle of the electrical signal output from the 1st time delay circuit, the phase angle of the electrical signal output from the 2nd time delay circuit and the phase angle of the electrical signal output from the 3rd time delay circuit are consistent, that is the phase difference between the three electrical signals is 0, such that the electrical signal output from the sound receiving device has a maximum gain.

When the attenuation of the acoustic wave caused by transmission in the air is ignored, the sound receiving device can output an electrical signal of which the amplitude is nearly three times as that of an electrical signal output from a single microphone, that is, the gain of the sound receiving device can be up to or close to 4.77 dB.

When an acoustic signal with a frequency of the center frequency $f_0$ and a phase angle of $\alpha$ is backward and axially incident on the microphone array. The acoustic signal firstly reaches the 3rd microphone, and travels through the 2nd microphone and the 3rd time delay, where the delay time of the 3rd time delay circuit is 0 that the output electrical signal still has a phase angle of $\alpha$. The acoustic signal travels from the 3rd microphone to the 2nd microphone and travels through the 2nd time delay circuit, and the phase angle of the output electrical signal is a combination of $\alpha$, 120° caused by the delay time of the time delay circuit and 120° caused by the transmission distance, i.e., a+240°. The acoustic signal travels from the 2nd microphone to the 1st microphone and travels through the 1st time delay circuit, and the phase angle of the output electrical signal is a combination of $\alpha$, 240° caused by the delay time of the time delay circuit and 240° caused by the transmission distance, i.e., a+480°. It follows that when the attenuation of the acoustic wave caused by transmission in the air is ignored, the amplitude of the electrical signal finally output from the sound receiving device is 0 or close to 0.

That is, for a backward incoming acoustic signal with a frequency of the center frequency $f_0$, when the number of the microphones in the microphone array is 2, the sound receiving device can play an inhibition role in a backward axially incoming acoustic signal.

The total number n of the microphones in the microphone array is equal or greater than 3, i.e., the microphone array has at least 3 microphones. Once the microphone array has more microphones, the electrical signal corresponding to the forward acoustic signal, output from the microphone array and time delay circuits can has a greater gain within a certain frequency bandwidth, the attenuation of the backward acoustic signal can be further enhanced, and the directional characteristic of the acoustic signal can be improved.

Figure 2:
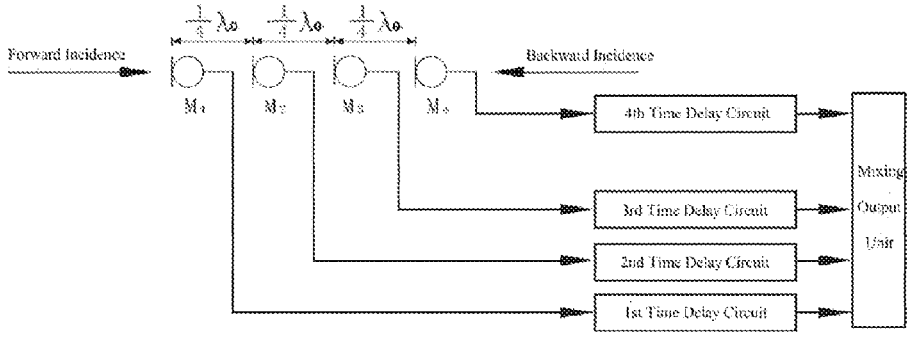
FIG. 2 is a structure diagram illustrating a sound receiving device according to another embodiment of the present invention.

As shown in FIG. 2, the microphone array of the sound receiving device includes four microphones which are M1, M2, M3 and M4. The four microphones are longitudinally arranged along a straight line in order, with a center frequency of $f_0$, the spacing distance between two adjacent microphones is $$\frac{1}{4}\lambda_0.$$

In a case, an acoustic signal with a frequency of the center frequency $f_0$ and a phase angle of 0° is incident on the microphone array at a angle of $\phi$=0°.

(1) At t1=0, the acoustic signal reaches the 1st microphone M1, and the acoustic signal received by the 1st microphone M1 has a phase angle that $\Phi 1'$=0°;

$$\text{At } t2 = \frac{1}{4}\lambda_0/C_0, \tag{2}$$

the acoustic signal reaches the 2nd microphone M2, and the acoustic signal received by the 2nd microphone M2 has a phase angle that $\Phi 2'$=90°;

$$\text{At } t3 = \frac{1}{2}\lambda_0/C_0, \tag{3}$$

the acoustic signal reaches the 3rd microphone M3, and the acoustic signal received by the 3rd microphone M3 has a phase angle that $\Phi 3'$=180°; and $$\text{At } t4 = \frac{3}{4}\lambda_0/C_0, \tag{4}$$

the acoustic signal reaches the 4th microphone M4, and the acoustic signal received by the 4th microphone M4 has a phase angle that Φ4'=270°.

Because the delay time of the 4th time delay circuit is 0, the delay time Ti of the i-th time delay circuit is $$T_i = \frac{(n-i)\cdot\lambda_0}{n\cdot C_0}.$$

In this case, n is 4, and i is 1, 2 or 3.

Based on the above expression, the delay times of the 1st time delay circuit, 2nd time delay circuit and 3rd time delay circuit can be calculated respectively, and the phase angles of the acoustic signals corresponding to the delay times of the 1st to 4th time delay circuits respectively can also be calculated, as follows.

(1) The delay time of the 1st time delay circuit is $$T_1 = \frac{3}{4}\lambda_0/C_0.$$

And the phase angle of the acoustic signal corresponding to the delay time is $\Phi_1''=270°$.

(2) The delay time of the 2nd time delay circuit is $$T_2 = \frac{1}{2}\lambda_0/C_0.$$

And the phase angle of the acoustic signal corresponding to the delay time is $\Phi_2''=180°$.

(3) The delay time of the 3rd time delay circuit is $$T_3 = \frac{1}{4}\lambda_0/C_0.$$

And the phase angle of the acoustic signal corresponding to the delay time is $\Phi_3''=90°$.

(4) The delay time of the 4th time delay circuit is 0.

And the phase angle of the acoustic signal corresponding to the delay time is $\Phi_4''=0°$.

The phase angles of the electrical signals output from the time delay circuits can be further calculated, as follows.

The acoustic signal travels through the 1st microphone and the 1st time delay circuit in sequence, and the output electrical signal has a phase angle that $\Phi_1=\Phi_1'+\Phi_1''=270°$.

The acoustic signal travels through the 2nd microphone and the 2nd time delay circuit in sequence, and the output electrical signal has a phase angle that $\Phi_2=\Phi_2'+\Phi_2''=270°$.

The acoustic signal travels through the 3rd microphone and the 3rd time delay circuit in sequence, and the output electrical signal has a phase angle that $\Phi_3=\Phi_3'+\Phi_3''=270°$.

The acoustic signal travels through the 4th microphone and the 4th time delay circuit in sequence, and the output electrical signal has a phase angle that $\Phi_4=\Phi_4'+\Phi_4''=270°$.

Based on the above, the electrical signals from the four microphone are delayed by respective time delay circuits, and the phase angles of the output electrical signals are 270°. Thus the electrical signal output from the sound receiving device has a maximum gain.

In another case, an acoustic signal with a frequency of the center frequency $f_0$ and a phase angle of 0° is incident on the microphone array at a angle of $\phi=180°$.

(1) At t5=0, the acoustic signal reaches the 4th microphone M4, and the acoustic signal received by the 4th microphone M4 has a phase angle that Φ4'=0°;

$$\text{At } t6 = \frac{1}{4}\lambda_0/C_0, \tag{2}$$

the acoustic signal reaches the 3rd microphone M3, and the acoustic signal received by the 3rd microphone M3 has a phase angle that Φ3'=90°;

$$\text{At } t7 = \frac{1}{2}\lambda_0/C_0, \tag{3}$$

the acoustic signal reaches the 2nd microphone M2, and the acoustic signal received by the 2nd microphone M2 has a phase angle that Φ2'=180°; and $$\text{At } t8 = \frac{3}{4}\lambda_0/C_0, \tag{4}$$

the acoustic signal reaches the 1st microphone M1, and the acoustic signal received by the 4th microphone M1 has a phase angle that Φ1'=270°.

Because the delay times of the time delay circuits corresponding to the microphones are the same as the above case, the phase angles are still the same that Φ1"=270°, Φ2"=180°, Φ3"=90° and Φ4"=0°.

The phase angles of the electrical signals output from the time delay circuits can be further calculated, as follows.

The acoustic signal travels through the 1st microphone and the 1st time delay circuit in sequence, and the output electrical signal has a phase angle that $$\Phi1=\Phi1'+\Phi1''=270°+270°=540°.$$

The acoustic signal travels through the 2nd microphone and the 2nd time delay circuit in sequence, and the output electrical signal has a phase angle that $$\Phi2=\Phi2'+\Phi2''=180°+180°=360°.$$

The acoustic signal travels through the 3rd microphone and the 3rd time delay circuit in sequence, and the output electrical signal has a phase angle that $$\Phi3=\Phi3'+\Phi3''=90°+90°=180°.$$

The acoustic signal travels through the 4th microphone and the 4th time delay circuit in sequence, and the output electrical signal has a phase angle that $$\Phi4=\Phi4'+\Phi4''=0°+0°=0°.$$

Based on the above, Φ1 and Φ2 have opposite phases, and Φ3 and Φ4 have opposite phases. When the attenuation of the acoustic wave caused by transmission in the air is ignored, the amplitude of the electrical signal finally output from the sound receiving device is 0, with a minimum gain.

Further, when the spacing distance between any two adjacent microphones is $$\frac{1}{n}\lambda_0,$$

and the number of microphones is an even number greater than or equal to 4, the attenuation of the output acoustic signal can maintain at a minimum within a certain frequency bandwidth.

As a preferred embodiment, the total number n of the microphones in the microphone array of the sound receiving device is an even number greater than or equal to 4. When the incidence angle $\phi$ is 180° and the attenuation of the acoustic wave caused by transmission in the air is ignored, the electrical signals output from the sound receiving device cancel each other to get the maximum attenuation.

Because the acoustic signal may be incident on the microphone array of the sound receiving device at different angles, when the incidence angle $\phi$ of the acoustic signal being incident on the microphone array is neither 0° nor 180°, the distance $$\frac{i-1}{n}\lambda_0\cos\varphi$$

that the acoustic signal travels to each microphone is varied in direction with the incidence angle $\phi$. The directivity of the sound receiving device is sharper than that of a single microphone due to $\cos\phi \leq 1$. When the directional characteristic of the single microphone is not omni-directional, the directional characteristic of the sound receiving device is sharper. As the number of the microphones increases, the gain of the output signal of the sound receiving device will continue to increase when the incidence angle $\phi$ of the acoustic signal is 0o, and the gain of the output signal of the sound receiving device will maintain at a minimum when the incidence angle $\phi$ of the acoustic signal is 180o, i.e., with the increase in the number of the microphones, the directivity of the sound receiving device will become sharper.

In addition, when the frequency f of the acoustic signal being incident on the sound receiving device is different with the center frequency $f_0$, i.e., $f \neq f_0$. The ratio of f to $f_0$ will affect the gain and directional characteristic of the sound receiving device.

Figure 3:
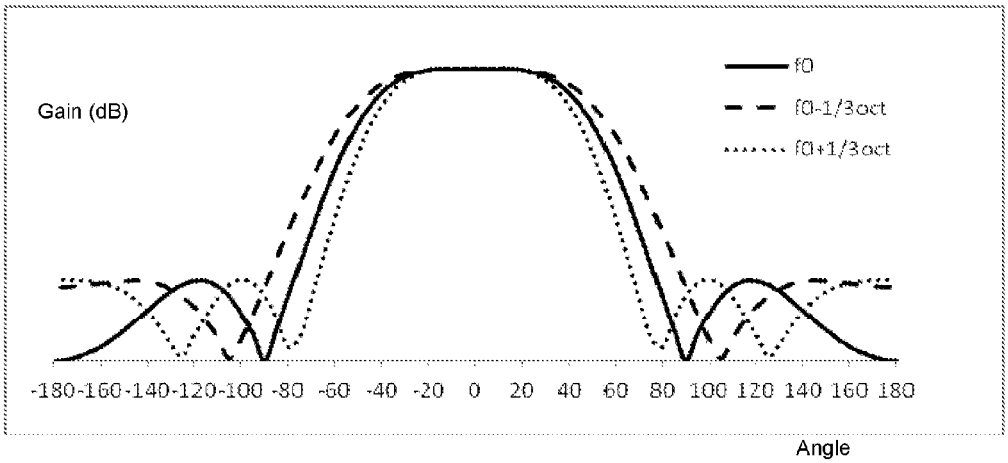
FIG. 3 is a schematic diagram showing a relationship between frequencies and directional responses of output of a sound receiving device including a microphone array including four microphones.

As shown in FIG. 3, showing a relationship between frequencies and directional responses of output of a sound receiving device including a microphone array including four microphones, when the ratio of f to $f_0$ is close to 1, the sound receiving device can only work in a narrow frequency range. Within a frequency range of (−⅓)~(+⅓) octave, the sound receiving device can obtain approximately identical gain and directional characteristic in the frequency range. Know then, the directional characteristic of the sound receiving device is related to the ratio of the frequency f of the acoustic signal being incident on the microphone array of the sound receiving device to the center frequency $f_0$ and is unrelated to the specific value of the center frequency $f_0$.

Therefore, according to the present invention, various sound receiving devices with different center frequencies $f_0$ can get obtain an identical directional characteristic.

Figure 4:
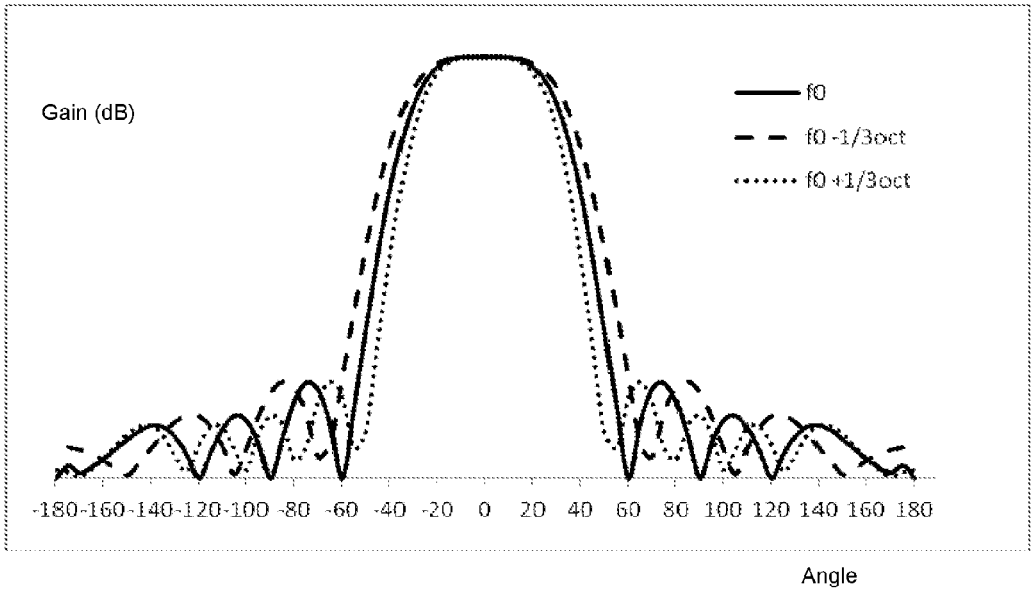
FIG. 4 is a schematic diagram showing a relationship between frequencies and directional responses of output of a sound receiving device including a microphone array including eight microphones.

As shown in FIG. 4, showing a relationship between frequencies and directional responses of output of a sound receiving device including a microphone array including eight microphones, when the ratio of f to $f_0$ is close to 1, the sound receiving device can only work in a narrow frequency range. Within a frequency range of (−⅓)-(+⅓) octave, the sound receiving device can obtain approximately identical gain and directional characteristic in the frequency range. Compared FIG. 3 with FIG. 4, we can see that the sound receiving device including a microphone array including eight microphones has a greater gain for forward acoustic wave, more attenuation for the backward acoustic wave, and better directional characteristic.

Therefore, the total number n of the microphones in the microphone array of the sound receiving device should be an even number greater than or equal to 4, and the greater the number of microphones, the better the directional characteristic of receiving the acoustic wave is.

Based on the characteristics of a single sound receiving device, if a plurality of sound receiving devices with different center frequencies $f_0$ make up a system, the system will has the similar gain and directional characteristic. The present invention can receive various acoustic signals with different frequencies, improve the output of the forward acoustic wave actuation of these frequencies and decrease the output of the oblique acoustic wave.

Based on the above, the present invention can selectively receive various acoustic signals, improve the output of the forward acoustic wave actuation of these frequencies and decrease the output of the oblique acoustic wave, within a certain frequency bandwidth. The present invention has wide applications. For example, it can be used for sound pickup (sound transmitting) in a conference. The sound receiving device of the present invention may be hung from the roof of the center of the conference room, such that most spokesmen can be covered, and when sound pickup (sound transmitting), various acoustic wave feedbacks can be suppressed without complicated regulation, howling is not easy to be produced, and unwanted noise can be isolated; it can be used for long distance sound pickup (sound transmitting) in a theatre, which not only covers the entire stage to record the required sound, but also blocks out interference from the grandstand in the theatre; and it can also be used for ultra distance special sound pickup (sound transmitting).

The embodiments are chosen and described in order to explain the principles of the present invention and their practical application so as to activate others skilled in the art to utilize the invention and various embodiments and with various modifications as are suited to the particular use contemplated. Alternative embodiments will become apparent to those skilled in the art to which the present invention pertains without departing from its spirit and scope. Accordingly, the scope of the present invention is defined by the appended claims rather than the foregoing description and the exemplary embodiments described therein.

What is claimed is:

1. A sound receiving device configured to receive an acoustic wave, comprising a microphone array designed to have a preset center frequency, a plurality of time delay circuits and a sound-mixing output device, wherein the microphone array comprises a plurality of microphones longitudinally arranged along a straight line, two adjacent microphones in the microphone array are separated with a distance of $$\frac{1}{n}\lambda_0,$$

where n is the total number of the microphones in the microphone array and $\lambda_0$ a wavelength defined by a speed of the acoustic wave in the air divided by the preset center frequency that is designed in the microphone array;

in the microphone array, an output terminal of each microphone is connected with a time delay circuit, and an output terminal of the time delay circuit is connected to an input terminal of the sound-mixing output device;

an i-th time delay circuit has a delay time Ti defined by adding a (n−i) times of unit time to a delay time of a last time delay circuit, where said unit time is a time for the acoustic wave with a frequency set at the present center frequency to travel between two adjacent microphones after the acoustic signal axially transmitting into the microphone array, n is the total number of the microphones in the microphone array, and i has a value of 1, 2, 3, . . . , or n; and the total number n of the microphones in the microphone array is an integer greater than or equal to 3.

2. The sound receiving device of claim 1, wherein the total number n of the microphones in the microphone array is an even number greater than or equal to 4.

* * * * *